United States Patent [19]

Franck et al.

[11] Patent Number: 4,911,822

[45] Date of Patent: Mar. 27, 1990

[54] COMBINED HYDROREFORMING-HYDROISOMERIZATION PROCESS

[75] Inventors: Jean-Pierre Franck, Bougival; Adrien Orieux, Rueil Malmaison; André Vidal, Le Vesinet, all of France

[73] Assignee: Institut Francais du Petrole, Rueil Malmaison, France

[21] Appl. No.: 38,555

[22] Filed: Apr. 15, 1987

[30] Foreign Application Priority Data

Apr. 16, 1986 [FR] France ..... 86 05568

[51] Int. Cl.[4] ..... C10G 35/04; C07C 5/13

[52] U.S. Cl. ..... 208/66; 208/64; 208/65; 585/734; 585/751

[58] Field of Search ..... 585/751, 734; 208/64, 208/65, 70, 66

[56] References Cited

U.S. PATENT DOCUMENTS

| | | | |
|---|---|---|---|
| 2,946,736 | 7/1960 | Muffat et al. | 585/737 |
| 3,018,244 | 1/1962 | Stanford et al. | 208/64 |
| 3,761,392 | 9/1973 | Pollock | 208/79 |
| 3,776,837 | 12/1973 | Dautzenberg et al. | 208/64 |
| 3,785,955 | 1/1974 | Davis | 208/80 |
| 3,925,503 | 12/1975 | Parthasarathy | 585/751 |
| 4,162,212 | 7/1979 | Miller | 208/64 |
| 4,181,599 | 1/1980 | Miller et al. | 208/80 |
| 4,457,832 | 7/1984 | Robinson | 208/135 |
| 4,665,272 | 5/1987 | Bakas et al. | 585/751 |
| 4,665,273 | 5/1987 | Johnson et al. | 585/751 |

*Primary Examiner*—Curtis R. Davis

*Attorney, Agent, or Firm*—Millen, White & Zelano

[57] ABSTRACT

The invention concerns a combined process of catalytically hydroreforming a heavy naphtha in at least one reaction zone (10) and catalytically hydroisomerizing a light naptha in at least one reaction zone (34).

The invention is characterized in that the hydrogen produced in the hydroreforming unit (line 27) is used to isomerize the light naphtha, the obtained reformate and isomerate being fractionated preferably together in the same stabilization column (51 in FIG. 1).

A better thermal integration, a better recovery of light hydrocarbons and a lowering of the utilities requirements and investments, as compared with units operating separately, are thus achieved.

17 Claims, 2 Drawing Sheets

COMBINED HYDROREFORMING-HYDROISOMERIZATION PROCESS

BACKGROUND OF THE INVENTION

In catalytic reforming processes, the charge is generally a naphtha distilling for example between 60° and 200° C., in particular straight-run naphthas. Light naphthas are mostly removed by distillation, their reforming being of little interest since they cannot be converted to aromatics and are not much isomerized. These light naphthas are then either recovered as such for the gasoline pool, or upgraded by isomerization in a separate unit.

The isomerization of normal paraffins of low molecular weight is of primary importance in the oil industry, in view of the particularly high octane number of isoparaffins.

The conversion of $C_4$–$C_7$ and mainly $C_5$–$C_6$ n-paraffins to isoparaffins is interesting for improving light gasoline fractions, particularly the straight-run top fractions, in order to obtain a motor fuel of high octane number.

Naphthas, usually called heavy naphthas, are thus the only feed to the reforming unit.

In the process according to the invention, a reforming unit is used jointly with an isomerization unit to satisfy the new regulations for manufacturing lead-free gasoline, particularly in Europe and the U.S.A. For upgrading light naphtha cuts, it has been suggested to integrate the isomerization unit with the reforming unit in order to minimize the investment and the utilities requirements. Until recently, isomerization reactions were conducted with chlorine injection, using as a catalyst a carrier having a group VIII noble metal incorporated therewith, the carrier being for example impregnated with a hydrocarbylaluminum halide of the formula:

$$AlX_yR_{(3-y)}$$

wherein

- y is 1 or 2
- X is a halogen and
- R is a hydrocarbon monovalent radical (British patent 1,432,639)

Catalysts of the Friedel and Crafts type, such as aluminum chloride, can also be used. In addition to the conventional catalysts such as platinum on silica-alumina, halogenated alumina or other acid carriers, U.S. Pat. No. 3,903,192 indicates the use of alumina carriers with introduction into alumina of halogen and of at least one compound of metal from group VI or VIII of the periodic classification of elements, in the presence of a mixture of chlorine and/or hydrochloric acid.

All these catalysts may be used for isomerizing, in hydrogen atmosphere, paraffins containing 4 to 7 carbon atoms and preferably 5 and/or 6 carbon atoms, at a temperature from 50° to 250° C. The operation is preferably conducted under a pressure from 5 to 100 kg/cm$^2$ (5–100 bars) with a space velocity from 0.2 to 10 liters of charge per liter of catalyst and per hour. It may be convenient to continuously or periodically introduce into the charge a halogenated promoter, for example hydrochloric acid, carbon tetrachloride, or an alkyl halide such for example as ethyl chloride, isopropyl chloride, tert-butyl chloride or tert-butyl bromide.

SUMMARY OF THE INVENTION

According to the present invention, a first charge, consisting in major part of heavy naphtha, is supplied, through at least one heating zone, to at least two catalytic reforming zones arranged in series, the effluent from each reforming zone, except the effluent from the last reforming zone wherethrough passes the charge, also circulating through at least one heating zone (which can be the same as the heating zone already used to heat the heavy naphtha before introducing it into the reforming zone), the effluent from the last reforming zone being subjected to at least one fractionation in order to obtain a reformate and a first stream of a hydrogen-containing gas, at least a portion of said hydrogen being admixed with a second charge formed in major part of light naphtha, the resultant mixture being preheated before being introduced into a catalytic isomerization zone wherefrom an isomerizate is withdrawn. This preheating may be conducted either by circulating the resultant mixture directly through the fumes of at least one of the above-defined heating zones, or by indirect contacting with steam, or by indirect contacting with the effluent from the last reforming zone wherethrough passes the heavy naphtha.

The hydrogen generated during the reforming reaction meets the hydrogen requirements of the light naphtha isomerization unit (correct $H_2$/hydrocarbon ratio). Thus, by integrating the reforming with the isomerization according to the invention, the light cut may be treated by using the existing equipment of the reforming unit:

the operating thermal level of the isomerization reactor is obtained with optimum effect either by heat recovery from the fumes of the reforming furnaces or indirectly.

fresh and recycle hydrogen are supplied by means of the hydrogen compressor (recontacting) of the reforming unit, the isomerization unit operates without hydrogen recycling, thus reducing to a corresponding extent the utilities requirements as compared with an isomerization unit which would operate independently from the reforming unit (the gas purity is higher), the recovery of light hydrocarbons at the output of the reaction zone of the isomerization unit is improved by recontacting with the reformate.

But, according to the invention, in order to obtain correct operation of the isomerization zone, it is not possible to use the above-described conventional isomerization catalysts, since the use of such catalysts would require the introduction of halogen or halogenated compound, mainly chlorine. The process according to the invention is only conceivable with a new generation of particularly adapted catalysts, operable in the absence of halogen and halogenated compounds. According to the invention, the catalysts comprise a zeolite carrier, usually diluted in a generally amorphous matrix. The isomerization (hydroisomerization) catalyst may optionally contain preferably at least one group VIII metal, for example platinum, palladium or nickel. When containing platinum and palladium, the catalyst contains (by weight) from 0.05 to 1%, preferably from 0.1 to 0.6% of said metals. When containing nickel, the catalyst content by weight of the latter is from 0.10 to 10%, preferably from 0.2 to 5%.

The isomerization catalysts used according to the invention comprise a zeolite, advantageously a mordenite, in acid form, with or without hydrogenation promoter(s). Preferably the so-called large-pore mordenites are used. As a matter of fact, two types of mordenite exist, which distinguish from each other by their adsorption properties: the large-pore mordenites, always synthetic, adsorb molecules such as benzene (kinetic diameter = 6.6 Å) and the small-pore mordenites, natural or synthetic, only adsorb molecules of a kinetic diameter lower than about 4.4 Å. These mordenites also distinguish from each other by their differences in morphology-needles for the small-pore mordenites, spherulites for the large-pore mordenites-and in structure: the presence or absence of defects. In all the literature, e.g. U.S. Pat. No. 3,190,939, U.S. Pat. No. 3,480,539 and U.S. Pat. No. 3,551,353, large pore mordenites are described.

A particularly convenient mordenite for use according to the invention is prepared from a small-pore mordenite under such conditions that said mordenite will retain the morphology of the small-pore mordenite while having nevertheless the capacity to adsorb benzene molecules (kinetic diameter: 6.6 Å) in contrast with a small-pore mordenite not subjected to the special treatment. The use of said specially treated mordenite of a particular morphology (needles) results in a substantial gain of activity and selectivity for the isomerization reaction.

It is possible to "unclog" the channels of said particular zeolite by treatment with a strong inorganic acid and/or by roasting in the presence of steam so as to obtain an adsorption capacity close to that of the large-pore mordenite.

These small-pore synthetic mordenites may be obtained by synthesis, particularly under the following conditions: temperature ranging from about 200° to 300° C. and crystallization time of 5–50 hours.

The zeolite preferably used in the catalyst according to the invention is manufactured from a small-pore mordenite whose sodium content generally ranges from 4 to 6.5% (by weight) in proportion to the weight of dry mordenite, whose Si/Al atomic ratio generally ranges from 4.5 to 6.5 and whose mesh volume generally ranges from 2.80 to 2.77 $nm^3$. This mordenite only adsorbs molecules of kinetic diameter lower than about 4.4 Å. After treatments, the mordenite is characterized by different specifications: a Si/Al atomic ratio from 5 to 50, preferably from 5.5 to 30, a sodium content lower than 0.2% by weight, preferably lower than 0.1% in proportion to the dry zeolite weight, a mesh volume V of elementary mesh from 2.78 to 2.73 $nm^3$, preferably from 2.77 to 2.74 $nm^3$, a benzene adsorption capacity higher than 5%, preferably higher than 8%, in proportion to the weight of dry solid (zeolite), a particular morphology corresponding to a major part of needles, preferably of 5 micron average length, having hexagonal faces of about 1 micron length and about 0.3 micron height.

The so-prepared mordenite, destined to hydroisomerization reactions, is then admixed with a generally amorphous matrix, the hydroisomerization catalyst also containing preferably at least one group VIII metal, particularly platinum, palladium and nickel, optionally with one group IV metal: tin, germanium or lead. The matrix may be alumina, silica-alumina, a natural clay (e.g. kaolin or bentonite), alumina-boron oxide. The mordenite content of the catalyst is advantageously higher than 40% (preferably 60%) by weight.

This catalyst is excellent for hydroisomerizing cuts containing a high proportion of normal paraffins with 4 to 7 carbon atoms, preferably 5–6 carbon atoms per molecule, of enhanced selectivity and activity as compared with conventional hydroisomerization catalysts.

As above-mentioned, the heavy naphtha is subjected to catalytic reforming in the presence of hydrogen in at least two reaction zones.

The general conditions of catalytic hydroreforming are as follows: in each reaction zone, the average temperature ranges from about 480° to 600° C., the pressure from about 5 to 20 $kg/cm^2$ (5–20 bars), the hourly velocity from 0.5 to 10 volumes of liquid naphtha per volume of catalyst and the recycling rate from 1 to 10 hydrogen moles per mole of charge.

The catalyst may contain for example at least one metal from the platinum family, i.e. a noble metal such as platinum, palladium, iridium, rhodium, ruthenium, osmium, deposited on a carrier consisting of alumina or of an equivalent compound (examples: platinum-alumina-halogen or platinum-iridium-halogen). The total noble metal content is from 0.1% to 2% by weight in proportion to the catalyst and the halogen, preferably chlorine or fluorine, content is from 0.1 to 10%. The alumina-halogen association may be replaced by other carriers, for example silica-alumina. The catalyst may contain at least one other metal promoter selected from various groups of the periodic classification of elements.

The operation may be conducted in many different manners:

A first manner consists of using a fixed bed in several reactors. The charge passes successively through the reactors; the catalyst is used over long periods before being regenerated.

According to another process, called "regenerative", the catalyst is regenerated either frequently or continuously:

(a) the frequent regeneration is performed when using several reactors containing a fixed bed catalyst. One of these reactors is in the course of regeneration (or waiting for regeneration), while the other reactors are in operation;

(b) the catalyst flows downwardly in each reactor (moving bed) and the regeneration is for example continuous in a main reactor, in order to avoid stopping the reaction. The catalyst may progressively flow successively through each reaction zone.

BRIEF DESCRIPTION OF THE DRAWINGS

The accompanying drawings are given to illustrate non limitative embodiments of the invention.

In these drawings.

DETAILED DESCRIPTION OF THE DRAWINGS

Figure 1:
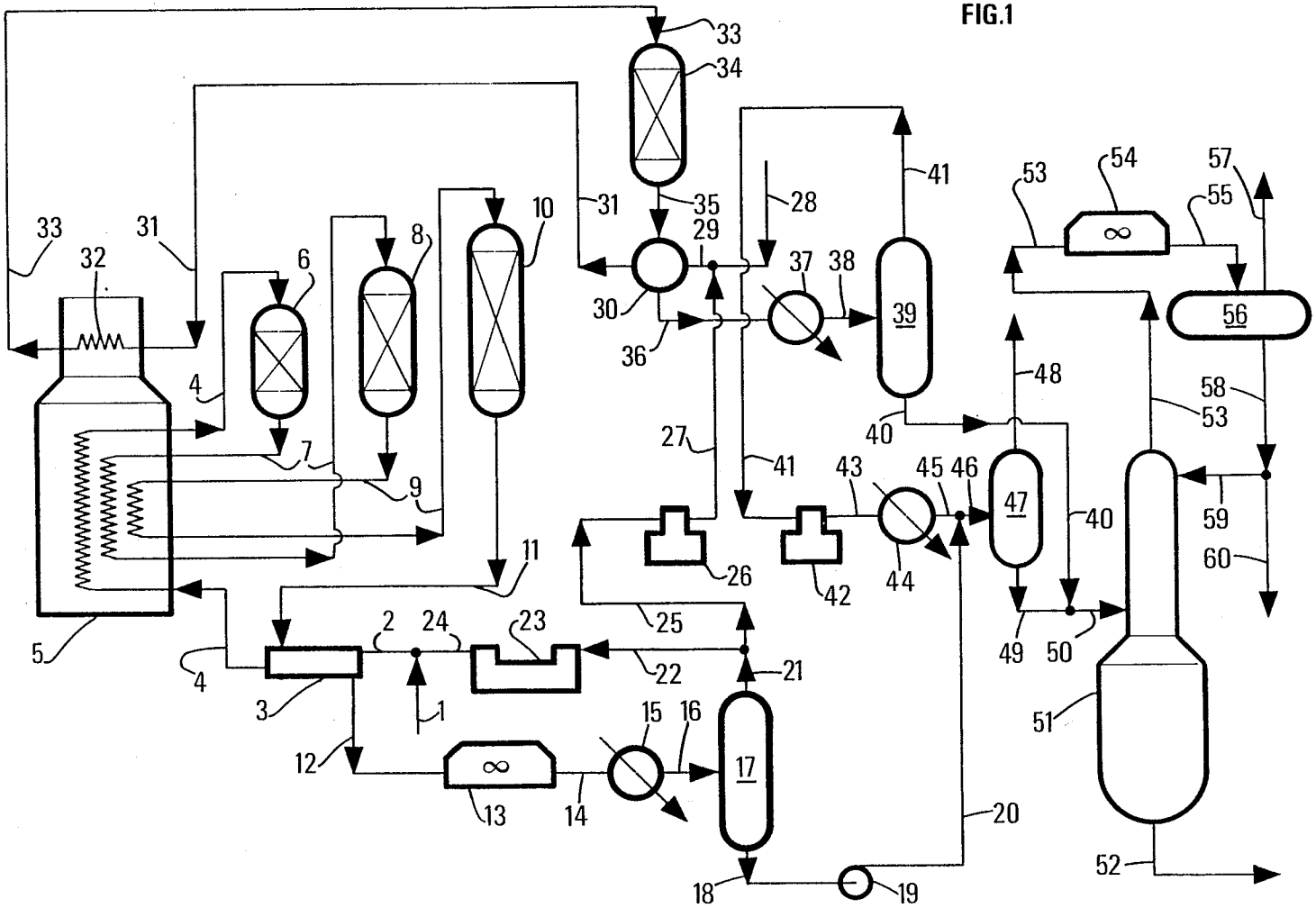
FIG. 1 is a flow sheet corresponding to a first embodiment of the invention.

According to FIG. 1, a heavy naphtha is introduced into the unit through line 1, passes through line 2 into heat exchanger 3 and through line 4 into a furnace 5. At the furnace output, the heavy naphtha, conveyed through line 4, is introduced into a first reforming reactor 6, here containing a catalyst fixed bed. The effluent from reactor 6 is withdrawn through line 7 and passes through furnace 5 before being supplied to a second reactor 8, also containing a catalyst fixed bed. The effluent from said second reactor is fed, through line 9, also passing through furnace 5, to a third reactor 10 containing a catalyst fixed bed. The effluent from reactor 10, withdrawn through line 11, passes through exchanger 3, line 12, coolers 13 and 15, lines 14 and 16 and is fed to a separation vessel 17 from the bottom of which a reformate is recovered through line 18.

From the top of separator 17, a gas essentially consisting of hydrogen is withdrawn through line 21. At least a portion of said gas may be supplied (recycle hydrogen) through line 22, compressor 23 and line 24, to the reforming unit, after admixture in line 2 with the heavy naphtha charge. At least another hydrogen portion from line 21 is admixed, after passage through line 25, at least one compression stage 26 and line 27, with the light naphtha charge introduced into the unit through line 28 (an alternative embodiment would consist of taking hydrogen from line 25, not at the output from vessel 17, through line 21, but at the output of compressor 23, hence from line 24, so as to take advantage, in line 25, of the pressure increase through compressor 23). The light naphtha-hydrogen mixture originating from the reforming zone passes through line 29 to exchanger 30, is conveyed through line 31 and heated in line 32, at the upper part of furnace 5, by the fumes of the reforming furnace. Another method for heating the mixture of line 31 would consist of indirectly contacting said mixture with steam produced in the fumes in order to perform a heat exchange. Still another method (FIG. 1A) would consist in dividing the effluent from the last hydroreforming reactor 10 into two portions, one portion circulating, as in FIG. 1, through exchanger 3 and then through line 12 and another portion supplying heat (through line 11*a*) to an exchanger 32*a*, wherethrough passes the mixture of line 31, which is then conveyed through line 33 to the hydroisomerization reactor 34, here containing a catalyst fixed bed (a moving bed could also be used). The effluent from the isomerization zone, discharged through line 35, passes through exchanger 30, line 36 and cooler 37 and is introduced through line 38 into the separation vessel 39. From line 41, at the top of said separation vessel, a gas of high hydrogen content is recovered., From the bottom of separator 39, an isomerizate is recovered through line 40. It is possible, according to the invention, to conventionally and separately treat the reformate from line 18 and the isomerizate from line 40: each of these effluents may thus be fed to a stabilization column, the different fractions, originating respectively from the reformate and from the isomerizate, being recovered for their customary uses in refining. However, the device used according to the present invention makes it possible to omit the stabilization column of the isomerization unit and to treat the isomerizate and the reformate in a single column. Then, the reformate withdrawn from the separation vessel 17, through line 18, is supplied, through pump 19, to line 20 and then admixed, in line 46, with at least a portion of the gas of high hydrogen content withdrawn through line 41 from separation vessel 39, which gas previously passed through compressor 42, lines 43 and 45 and cooler 44. This reformate-gas mixture is supplied to the separation vessel 47 wherefrom a gas of high hydrogen content is recovered at the top (line 48) and a reformate at the bottom (line 49), said reformate being admixed with the isomerizate from line 40 and the obtained mixture fed, through line 50, to the stabilization column 51. An isomerizate and reformate mixture of excellent quality is recovered from the column bottom through line 52. From the top of the column, light gases are recovered through line 53, cooled in 54 and treated in a separation vessel 56. Thus, a few light vapors are recovered, through line 57, and light distillates through lines 58 and 60, a part of these distillates being recycled through line 59 to the stabilization column 51. It may be advantageous to provide line 27 with a chlorine seal pot, not shown in FIG. 1.

Figures 1A, 2:
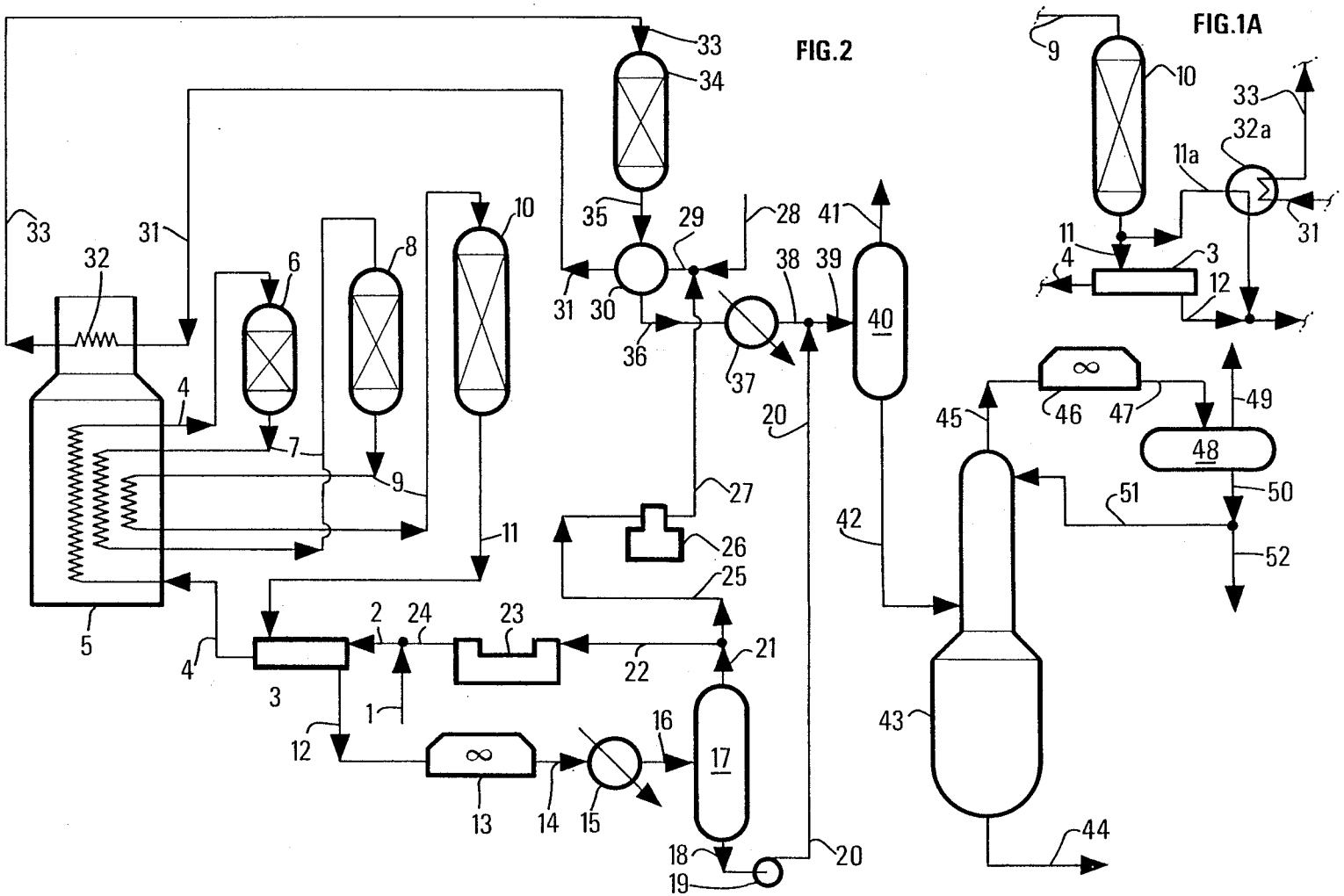
FIG. 1A is a flow sheet illustrating a modification of said first embodiment.
FIG. 2 is a flow sheet illustrating an alternative embodiment of the invention.

FIG. 2 illustrates an alternative embodiment of the invention. Here, the reformate is also admixed with the isomerization effluent but this effluent does not pass through the separation vessel 39 of FIG. 1, which is omitted in this embodiment. A heavy naphtha is introduced into the unit through line 1, passes through line 2, heat exchanger 3 and line 4 in furnace 5. At the output of the furnace, the heavy naphtha, conveyed through line 4, is introduced into a first reforming reactor 6, here containing a catalyst fixed bed. The effluent from reactor 6 is withdrawn through line 7 and passes through furnace 5 before being supplied to a second reactor 8, also containing a catalyst fixed bed according to the embodiment of the figure. The effluent from said second reactor is also conveyed, in line 9 passing through furnace 5, to a third reactor 10, containing a catalyst fixed bed. The effluent from reactor 10, withdrawn through line 11, passes through exchanger 3, line 12, coolers 13 and 15, lines 14 and 16, and is fed to separation vessel 17 from the bottom of which a reformate is recovered through line 18.

A gas, essentially consisting of hydrogen, is withdrawn through line 21 from the top of separator 17. At least a portion of said gas (recycle hydrogen) may optionally be supplied through line 22, compressor 23 and line 24 to the reforming unit, after admixture in line 2 with the charge of heavy naphtha. At least another portion of the hydrogen from line 21 is admixed, after passage through line 25, at least one compressor 26 and line 27 (line optionally provided with a chlorine seal pot), with the light naphtha charge introduced into the unit through line 28. As explained in relation to FIG. 1, it must be observed that the content of line 25 may originate from line 24 after passage through compressor 23. The mixture of light naphtha with hydrogen originating from the reforming zone passes through line 29, exchanger 30, line 31 and is heated in line 32, at the upper part of furnace 5, by the fumes of the reforming furnace. But it is possible, as for the embodiment of FIG. 1, to proceed by indirect heating with steam production and heat exchange or still, (as shown in FIG. 1A) to proceed by heating with at least a portion of the effluent from the last reforming reactor.

Then the mixture, conveyed through line 33, is fed to the hydroisomerization reactor 34, here containing a catalyst fixed bed (a moving bed might also be used). The effluent from the isomerization zone, discharged through line 35, passes through exchanger 30, line 36 and cooler 37, and is then admixed, through line 38, into line 39, with the reformate withdrawn from the separation vessel 17 and supplied through pump 19 and line 20, the resultant mixture being fed to the separation vessel 40. A gas of high hydrogen content is recovered at the top of said separation vessel 40. From the bottom thereof an isomerizate—reformate mixture is recovered through line 42. This mixture is fed to the stabilization column 43, from the bottom of which an isomerizate—reformate mixture of excellent quality is recovered through line 44. Light gases, recovered through line 45 from the top of said column and cooled in cooler 46, are then treated in the separation vessel 48. Thus, a few light hydrocarbons in vapor phase are recovered through line 49 and light distillates in liquid phase through lines 50 and 52; a portion of these distillates are recycled through line 51 to the top of the stabilization column 43.

EXAMPLE

The following example is given to further illustrate the invention and must not be considered as limiting the scope thereof.

This example concerns the treatment in the unit of a heavy naphtha charge (supplied through line 1) of 21 500 BPSD (about 140 $m^3$/hour) having the following composition:

| | |
|---|---|
| P/N/A (vol. %) | 67.5/18.8/13.7 |
| ASTM distillation (% volume), ° C. | |
| IBP | 85 |
| 10 | 98 |
| 30 | 105 |
| 50 | 114 |
| 70 | 127 |
| 90 | 147 |
| 95 | 158 |
| 100 | 185 |
| Impurities | |
| Nitrogen | 1 ppm max |
| Chlorine | 1 ppm max |
| Water | 1 ppm max |
| Sulfur | 1 ppm max |
| Metals | |
| AS | 5 ppb max |
| Pb | 5 ppb max |
| Cu | 5 ppb max |
| Fe | 5 ppb max |
| ni | 5 ppb max |

Line 28 is fed with 6 800 BPSD (about 45 $m^3$/hour) of light naphtha charge whose composition is as follows: (% by weight):

| | |
|---|---|
| Iso-$C_4$ | 0.15 |
| n-$C_4$ | 0.85 |
| Iso-$C_5$ | 16.0 |
| n-$C_5$ | 29.2 |
| Cyclo-$C_5$ | 2.9 |
| 2-Methyl-$C_5$ | 23.2 |
| n-$C_6$ | 19.9 |
| Methyl-cyclo-$C_5$ | 3.5 |
| Cyclo-$C_6$ | 1.2 |
| Benzene | 2.5 |
| $C_7^+$ | 0.6 |
| | 100.0 |

When using the embodiment of FIG. 1, a gas of high hydrogen content is recovered from line 48. It has the following composition:

| Composition (% vol.) | |
|---|---|
| $H_2$ | 93.6 |
| Cl | .9 |
| $C_2$ | 2.2 |
| $C_3$ | 1.2 |
| $iC_4$ | .5 |
| $nC_4$ | .3 |
| $iC_5$ | .6 |

-continued

| Composition (% vol.) | |
|---|---|
| $nC_5$ | .3 |
| $C_6^+$ | .4 |
| | 100.0 |
| Molecular weight | 4.75 |
| Flow rate | 36 150 $Nm^3$/h |

When using the embodiment of FIG. 2, a gas of high hydrogen content is recovered from line 41. It has the following composition:

| Composition (% vol.) | |
|---|---|
| $H_2$ | 92.7 |
| Cl | .9 |
| $C_2$ | 2.2 |
| $C_3$ | 1.3 |
| $iC_4$ | .6 |
| $nC_4$ | .3 |
| $iC_5$ | 1.0 |
| $nC_5$ | .4 |
| $C_6^+$ | .6 |
| | 100.0 |
| Molecular weight | 5.35 |
| Flow rate | 36 500 $Nm^3$/h |

The product, consisting of an isomerizate and reformate mixture is recovered at a rate of 25 175 BPSD (about 166 $m^3$/hour) from line 52 (embodiment of FIG. 1) or line 44 (embodiment of FIG. 2).

It has the following characteristics:

| Property | |
|---|---|
| $d_{15}^4$ | .767 |
| ASTM (vol %) | |
| IP | 40 |
| 10 | 53 |
| 30 | 75 |
| 50 | 95 |
| 70 | 120 |
| 90 | 150 |
| FP | 200 |
| RON clear | 95 |

The operating conditions were as follows:

| | T °C. | P (bar) | VVH |
|---|---|---|---|
| Reforming | 480 | 6 | 1.5 |
| Isomerization | 250 | 25 | 2 |

What is claimed as the invention is:

1. A combined process for heavy naphtha hydroreforming and light naphtha hydroisomerization, wherein a first charge, containing a major part of heavy naphtha, is fed, through at least one heating zone, to at least two catalytic hydroreforming zones arranged in series, the effluent from each hydroreforming zone, except the effluent from the last reforming zone wherethrough passes the charge, also circulating through at least one heating zone, the effluent from the last reforming zone being subjected to at least one fractionation so as to obtain a reformate and a hydrogen-containing gas, at least a portion of said hydrogen being admixed with a second charge containing a major part of light naphtha, the resultant mixture being preheated and then introduced into a catalytic hydroisomerization zone, the reformate and the effluent from the hydroisomerization zone are collected together and subjected to fractionation in the same stabilization column in order to obtain an improved isomerizate and reformate mixture, said process further comprising the use in the hydroisomerization zone of a catalyst containing at least one zeolite, the hydroisomerization being conducted without introduction of halogen or halogen compound into the hydroisomerization zone.

2. A process according to claim 1, wherein the hydroisomerization effluent is subjected to at least one fractionation in order to obtain a second stream of hydrogen-containing gas and an isomerizate, and wherein said second stream of hydrogen-containing gas is first treated with at least a portion of said reformate and then the reformate is admixed with at least a portion of the isomerizate, the resulting reformate-isomerizate mixture being subjected to fractionation in the same stabilization column in order to obtain an improved isomerizate and reformate mixture.

3. A process according to claim 1, wherein the catalyst used in the hydroisomerization zone contains at least a mixture of mordenite with a matrix.

4. A process according to claim 1, wherein the catalyst further contains at least one metal from group VIII of the periodic classification of elements.

5. A process according to claim 1, wherein, in the hydroisomerization zone, the catalyst consists essentially of a large-pore mordenite adsorbing molecules of a kinetic diameter larger than about 6.6 Å, having a Si/Al atomic ratio from about 5 to 50, a sodium content lower than 0.2% by weight in proportion to the total amount of dry zeolite, a mesh volume V, of elementary mesh, ranging from 2.78 to 2.75 $nm^3$, a benzene adsorption capacity higher than 5% by weight in proportion to the dry zeolite weight, the zeolite being in major part shaped as needles.

6. A process according to claim 5 wherein the catalyst consist essentially of a large-pore mordenite adsorbing molecules of kinetic diameter larger than about 6.6 Å, having a Si/Al atomic ratio from 5.5 to 30, a sodium content lower than 0.1% by weight in proportion to the total amount of dry zeolite, a volume of elementary mesh from 2.77 to 2.74 $nm^3$, a benzene adsorption capacity higher than 8% in proportion to the dry zeolite weight, said zeolite being in major part shaped as needles of 5 μm average length, having faces, in major part hexagonal, of about 1 μm length and about 0.3 μm height.

7. A process according to claim 1, wherein another portion of the hydrogen obtained after fractionation of the reformate is recycled to the hydroreforming zones.

8. A process according to claim 1, wherein the light naphtha and the effluents from each reforming zone (except the effluent from the last reforming zone) are heated in the same heating zone.

9. A process according to claim 8, wherein the mixture of light naphtha with said hydrogen portion obtained after fractionation of the reformate is directly preheated by the fumes of the heating zone.

10. A combined process for heavy naphtha hydroreforming and light naphtha hydroisomerization, wherein a first charge, containing a major part of heavy naphtha, is fed through at least one heating zone to at least two catalytic hydroreforming zones arranged in series, the effluent from each hydroreforming zone, except the effluent from the last reforming zone wherethrough passes the charge, also circulating through at least one heating zone, the effluent from the last reforming zone being subjected to at least one fractionation so as to obtain a reformate and a hydrogen containing gas, a portion of said hydrogen-containing gas being admixed with a second charge containing a major part of light naphtha, the resultant mixture being preheated and then introduced into a catalytic hydroisomerization zone, the hydroisomerization effluent is subjected to at least one fractionation in order to obtain a second stream of hydrogen-containing gas and an isomerizate, and wherein said second stream of hydrogen-containing gas is first treated with at least a portion of said reformate and then the reformate is admixed with at least a portion of the isomerizate, the resulting reformate-isomerizate mixture being subjected to fractionation in the same stabilization column in order to obtain an improved isomerizate and reformate mixture, said process further comprising the use in the hydroisomerization zone of a catalyst containing at least one zeolite, the hydroisomerization being conducted without introduction of halogen or halogen compound into the hydroisomerization zone.

11. A process according to claim 10, wherein the catalyst used in the hydroisomerization zone contains at least a mixture of mordenite with a matrix.

12. A process according to claim 10, wherein the catalyst further contains at least one metal from group VIII of the periodic classification of elements.

13. A process according to claim 10, wherein, in the hydroisomerization zone, the catalyst consists essentially of a large-pore mordenite adsorbing molecules of a kinetic diameter larger than about 6.6 Å, having a Si/Al atomic ratio from about 5 to 50, a sodium content lower than 0.2% by weight in proportion to the total amount of dry zeolite, a mesh volume V, of elementary mesh, ranging from 2.78 to 2.75 $nm^3$, a benzene adsorption capacity higher than 5% by weight in proportion to the dry zeolite weight, the zeolite being in major part shaped as needles.

14. A process according to claim 13, wherein the catalyst consists essentially of a large-pore mordenite adsorbing molecules of kinetic diameter larger than about 6.6 Å, having a Si/Al atomic ratio from 5.5 to 30, a sodium content lower than 0.1% by weight in proportion to the total amount of dry zeolite, a volume of elementary mesh from 2.77 to 2.74 $nm^3$, a benzene adsorption capacity higher than 8% in proportion to the dry zeolite weight, said zeolite being in major part shaped as needles of 5 μm average length, having faces, in major part hexagonal, of about 1 μm length and about 0.3 μm height.

15. A process according to claim 10, wherein the light naphtha and the effluents from each reforming zone, except the effluent from the last reforming zone, are heated in the same heating zone.

16. A process according to claim 15, wherein the mixture of light naphtha with said hydrogen portion obtained after fractionation of the reformate is directly preheated by the fumes of the heating zone.

17. A process according to claim 10, wherein another portion of the hydrogen obtained after fractionation of the reformate is recycled to the hydroreforming zones.

* * * * *